United States Patent [19]

LaBate

[11] Patent Number: 4,840,354

[45] Date of Patent: Jun. 20, 1989

[54] STIRRING BRICK WITH SHAPED GAS VOLUME CONTROL OPENINGS

[76] Inventor: Micheal D. LaBate, 115 Hazen Ave., Ellwood City, Pa. 16117

[21] Appl. No.: 209,834

[22] Filed: Jun. 22, 1988

[51] Int. Cl.[4] ..... C21C 5/48

[52] U.S. Cl. ..... 266/218; 266/270

[58] Field of Search ..... 266/218, 220, 265, 266, 266/270

[56] References Cited

U.S. PATENT DOCUMENTS

| | | | |
|---|---|---|---|
| 3,469,740 | 9/1969 | Crowe | 266/220 |
| 4,298,192 | 11/1981 | Barbakadge et al. | 266/218 |
| 4,396,179 | 8/1983 | LaBate | 266/220 |
| 4,413,815 | 11/1983 | Duhomez et al. | 266/266 |
| 4,438,907 | 3/1984 | Kimura et al. | 266/270 |
| 4,483,520 | 11/1984 | LaBate | 266/220 |
| 4,538,795 | 9/1985 | LaBate | 266/220 |
| 4,588,170 | 5/1986 | Towns | 266/225 |
| 4,632,367 | 12/1986 | LaBate | 266/220 |
| 4,661,153 | 4/1987 | Sinha | 266/270 |
| 4,687,184 | 8/1987 | LaBate et al. | 266/270 |
| 4,695,043 | 9/1987 | Winkelmann et al. | 266/265 |
| 4,705,563 | 11/1987 | Poeppel et al. | 266/270 |
| 4,725,047 | 2/1988 | LaBate | 266/270 |

FOREIGN PATENT DOCUMENTS

| | | | |
|---|---|---|---|
| 119629 | 6/1986 | Japan | 266/220 |

*Primary Examiner*—Robert McDowell

*Attorney, Agent, or Firm*—Harpman & Harpman

[57] ABSTRACT

A device for introducing gas into a mass of molten metal from a location in the side wall of a vessel for creating a stirring action therein has a refractory body having a plurality of passageways transversely thereof, the refractory body being positioned in the safety and working refractory lining of a ladle or the like so as to communicate with the interior thereof and molten metal therein. Tubular members positioned in or communicating with the passageways extend from the refractory body and upwardly to a chilling device which in turn communicates with a gas delivery tube through which a desirable supply of gas, such as argon, is delivered under pressure for introduction into the molten metal.

8 Claims, 1 Drawing Sheet

STIRRING BRICK WITH SHAPED GAS VOLUME CONTROL OPENINGS

BACKGROUND OF THE INVENTION

1. Technical Field:

This invention relates to devices for insufflating gas into a mass of molten metal in a vessel wherein the device is positioned in the refractory lining of the vessel and gas is introduced into the vessel therethrough.

2. Description of the Prior Art:

Prior structures for introducing gas into molten metal for stirring purposes or introducing refining agents and the like have generally utilized pocket blocks positioned in the bottom or lower surfaces of the ladle or other molten metal vessel, the pocket blocks having openings therethrough in which various devices including porous plugs, impervious plugs with spaced shells and the like are positioned to provide passageways for gas therethrough. Such prior art devices may be seen in U.S. Pat. Nos. 4,396,179 to LaBate, 4,383,520 to LaBate, 4,538,795 to LaBate, 4,632,367 to LaBate, 4,687,184 to LaBate, et al. and 4,725,047 to LaBate.

A side mounted lance for a ladle is disclosed in U.S. Pat. No. 4,588,170 (Jeffrey A. Towns, assigned to Insul Company, Inc.) in which a lance is positioned partially in the lining in the side wall of a ladle. A refractory nozzle built into the side wall of a metallurgical vessel providing a single passageway for the introduction of powdered reagents is described in U.S. Pat. No. 4,298,192 to Barbakadze, et al.

The present invention comprises an improvement with respect to the devices disclosed in my above-mentioned U.S. patents and the others in that a refractory block of a size and shape enabling it to be easily incorporated in the conventional refractory lining of a metallurgical vessel is disclosed as having a plurality of passageways transversely thereof which communicate with tubes through which a suitable source of stirring gas may be directed. The stirring block so formed is easily positioned in the refractory linings of a metallurgical vessel such as a ladle or the like and may be rather easily and quickly replaced if necessary and is so formed and shaped that the gas directed thereto effectively protects the portions thereof exposed to the molten metal as well as providing a cooling effect considerably increasing the useful life of the stirring block.

SUMMARY OF THE INVENTION

A stirring block having improved erosion resistance to molten metal is formed of a size and shape enabling it to be quickly and easily incorporated in the safety and working linings of a metallurgical vessel such as a ladle for containing molten metal. Such ladles normally have a safety refractory lining and a working lining which is usually a double layer of refractory brick. The stirring block of the present invention is sized and shaped to be readily incorporated in such linings, either initially or in a replacement lining. The stirring block is formed of a dense refractory material with the grain structure thereof preferably positioned so that it is generally parallel with the passageways so that the side of the stirring block that is exposed to the molten metal has considerably more resistance to erosion and therefore a greater life than is the case in the prior art where the grain structure in the refractory block is usually lengthwise thereof rather than transverse as in the present invention.

DESCRIPTION OF THE PREFERRED EMBODIMENT

Figure 1:
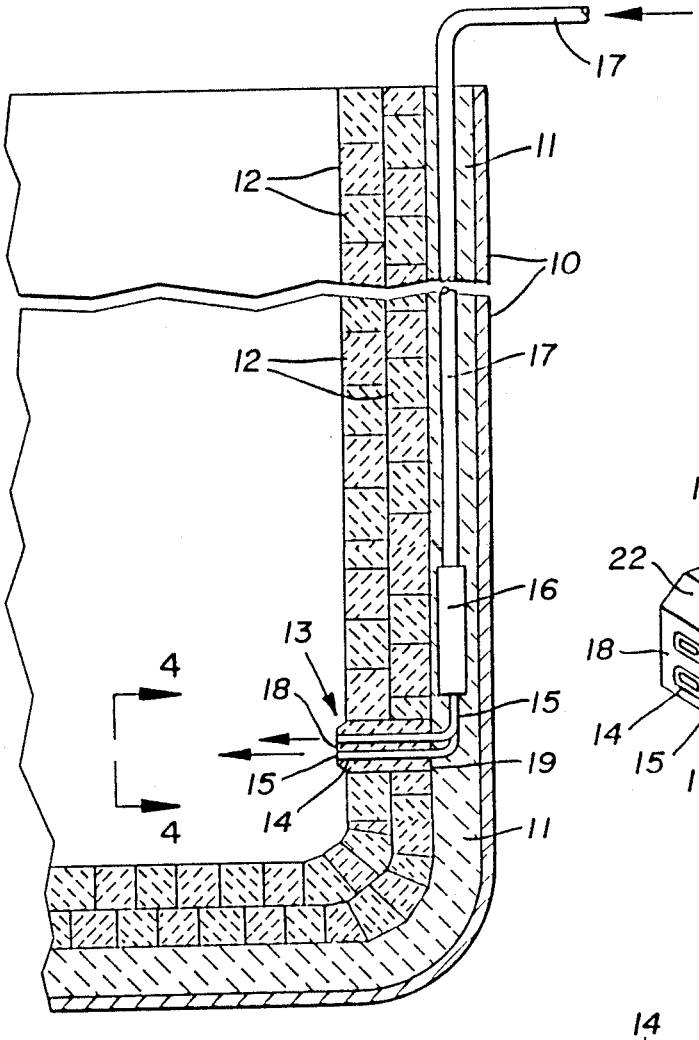
FIG. 1 is a vertical section of a portion of a ladle showing the stirring block positioned therein.

By referring to the drawings and FIG. 1 in particular it will be seen that a portion of a metallurgical vessel, such as a ladle 10, which may be of any suitable or conventional construction has been illustrated with a conventional safety lining 11 and working lining 12. The safety lining 11 is generally a rammed refractory material and the working lining 12 is illustrated as a double row of refractory bricks. Those skilled in the art will observe that the lining extends completely around the side walls of the metallurgical vessel and across the bottom thereof.

In FIG. 1 of the drawings, a refractory stirring block 13 is illustrated in vertical section positioned in the double row of refractory bricks comprising the working lining 12 and provided with a plurality of transverse passageways 14 which extend from a front face or side 15 of the refractory block 13 to the opposite or rear side 16 thereof. Each of the plurality of transverse passageways 14 are preferably defined by tubes 15 which extend out of the rear side of the refractory block 13 and are shaped so as to bend upwardly as illustrated in FIG. 1 of the drawings and in enlarged detail in FIGS. 2 and 3 of the drawings.

In FIG. 1 of the drawings, the tubes 15 communicate with the lower end of a molten metal chilling device 16 which is an elongated container positioned in the safety lining 11 of the metallurgical vessel and containing a plurality of metal pieces such as large steel shot or the like. Molten metal flowing into the stirring block 13 in the event of gas pressure failure will chill and freeze in the chilling device 16 and prevent escape of the molten metal from the metallurgical vessel. A single stirring gas supply pipe 17 communicates with the upper end of the chilling device 16 and extends out of the refractory lining of the metallurgical vessel at its upper end and is connected with a source of suitable stirring gas, not shown. The stirring gas may be argon or nitrogen as will be understood by those skilled in the art and its is supplied in sufficient pressure so that it will be directed into molten metal in the metallurgical vessel 10 to create a desired stirring action therein.

Figure 2:
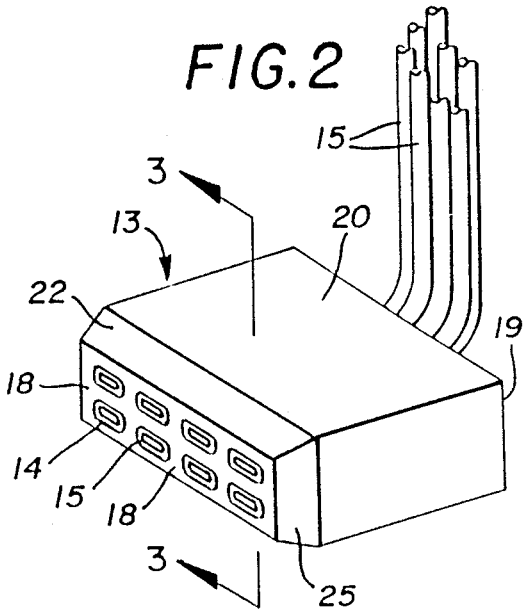
FIG. 2 is a perspective view illustrating the stirring block.

As illustrated in FIG. 2 of the drawings, the transvere passageways 14 and the tubes 15 are shaped in the manner of flattened ovals so that a predetermined volume of stirring gas at a known supply pressure is delivered thereby into the molten metal in the metallurgical vessel. It will occur to those skilled in the art that the flattened oval shapes of the transverse passageways 14 and tubes 15 may vary in the dimensions of the actual openings thus formed. For example the tubes 15 and the passageways 14 may take the form of elongated narrow slots and/or cross sectionally circular tubes which are of a known size communicating with the stirring block 13 and are of a relatively smaller size extending therethrough so that cross sectionally circular smaller jet-like openings are provided through which the gas is directed into the molten metal.

Figure 3:
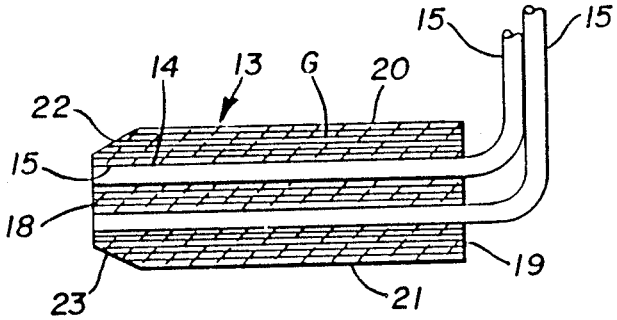
FIG. 3 is a vertical section on line 3—3 of FIG. 2 with horizontal lines illustrating a preferred directional grain structure.

By referring now to FIG. 3 of the drawings, it will be observed that the vertical section of the stirring block 13 illustrated therein has been provided with a plurality of horizontal lines G indicating the grain structure of the dense refractory material as extending from the front face or side 18 of the block 13 to the rear side 19 thereof and parallel with the passageways 14 and the shaped tubes 15. The desired grain structure which considerably improves the resistance to erosion may be formed in the stirring block by ramming or pressing the refractory material in a suitable form and in a vertical direction relative to the horizontal upper and lower surfaces 20 and 21 respectively thereof.

Figure 4:
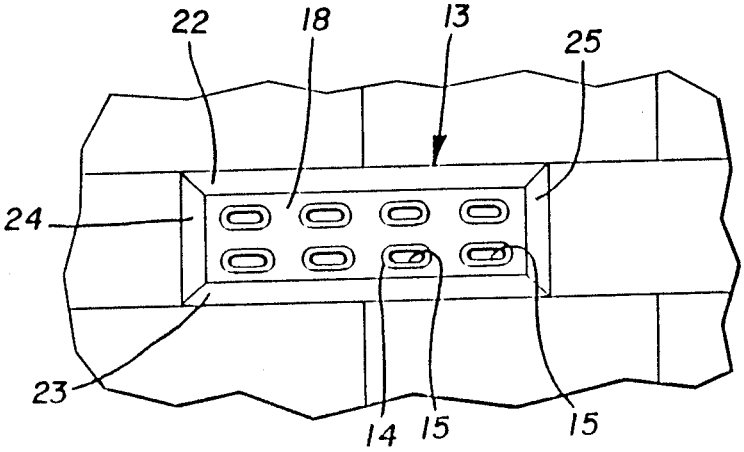
FIG. 4 is a plan view on line 4—4 of FIG. 1.

By referring now to FIG. 4 of the drawings, a plan view of the inner surface of the double row of refractory bricks 12 of the working lining of the metallurgical vessel of FIG. 1 may be seen and it will be observed that the overall size and shape of the refractory block 13 corresponds generally with the size and shape of the refractory brick 12 so that it is easily positioned in the working lining of the vessel when it is first lined and in successive relinings thereof. The refractory block 13 is rectangular with vertical front and back and end surfaces and horizontal upper and lower surfaces, the spacing between the upper and lower surfaces being about equal to one-half of the spacing between the front and back surfaces and the spacing between the end surfaces being about equal to double the spacing between the front and back surfaces. It will further be seen that the elongated oval shape of the passageways 14 and the shaped tubes 15 defining the same are spaced vertically and horizontally with respect to one another. It will also be seen that in the preferred embodiment of the invention the front face or side 18 of the stirring block 13 is preferably provided with oppositely disposed upper and lower tapered edges 22 and 23 respectively and oppositely disposed tapered edges 24 and 25 on its opposite ends which in effect spaces the foremost portion of the front face or side 18 of the stirring block 13 forwardly of the plane of the double row of refractory bricks 12 which line the metallurgical vessel. This shaping of the front face or side 18 of the stirring block improves the stirring action in the molten metal induced by the delivery of stirring gas thereinto as the flowing metal moves over the angular tapered edges away from the plane of the refractory bricks 12 and into the mass of molten metal in the metallurgical vessel 10 to a greater degree than will occur without the tapered edges.

It will occur to those skilled in the art that the stirring block 13 disclosed herein is secured in the indicated location in the working lining of the metallurgical vessel with refractory cement known in the art so that in effect is becomes a unit of the working lining of the vessel.

It will thus be seen that a novel and efficient stirring block for a metallurgical vessel such as a transport ladle or the like for molten meal, such as steel, has been disclosed in which the stirring block has a novel configuration and grain structure and controlled passageways and is so positioned in the vessel as to occupy minimum space therein and at the same time insure the desired delivery of the gas introduced therethrough into the molten metal to form a more effective stirring action.

Having thus disclosed my invention, what I claim is:

1. An improvement in apparatus for introducing gas into molten metal in a metallurgical vessel having a plurality of rectangular refractory bricks forming a protective refractory working lining on the bottom and side walls thereof, said improvement comprising a stirring block consisting of a refractory body member having horizontally disposed upper and lower surfaces and vertically disposed front, back, and end surfaces positioned in a side wall of said protective refractory working lining with said upper, lower, and end surfaces thereof in face to face engagement with said rectangular refractory bricks so as to form an unbroken continuation of the refractory working lining, a plurality of transverse passageways in said stirring block communicating with said front surface thereof and means establishing communication with said passageways and a source of stirring gas.

2. The improvement in apparatus for introducing gas into molten metal set forth in claim 1 and wherein the refractory body member is of generally rectangular shape and said upper and lower surfaces are vertically spaced planar surfaces and said front and back surfaces are horizontally spaced planar surfaces and said vertical end surfaces are horizontally spaced planar surfaces with said passageways extending between said front and back vertical planar surfaces.

3. The improvement in apparatus for introducing gas into molten metal set forth in claim 1 and wherein the refractory body member is of generally rectangular shape having vertically spaced upper and lower disposed planar surfaces, horizontally spaced front and back vertical surfaces and horizontally spaced vertical end surfaces with said passageways extending between said front and back vertical surfaces, the spacing of said upper and lower planar surfaces being about equal to onehalf of the spacing between said front and back vertical surfaces and the spacing between said vertical end surfaces being of equal to about double the spacing between said front and back vertical surfaces.

4. The improvement in apparatus for introducing gas into molten metal set forth in claim 1 and wherein said refractory body member has a grain structure extending perpendicularly to said front and back vertical surfaces.

5. The improvement in apparatus for introducing gas into molten metal set forth in claim 1 and wherein tubes are positioned in said passageways, said tubes being of a size to control the volume of gas directed therethrough so as to direct said gas into said molten metal in an effective stirring action.

6. The improvement in apparatus for introducing apparatus for introducing gas into molten metal set forth in claim and wherein said front surface of said refractory body member forming a continuation of the inner surface of said protective refractory brick working lining has a portion extending beyond said continuation of the inner surface of said protective refractory brick working lining with said extending portion having tapered edges so as to space a front surface of said extending portion with respect to said protective refractory brick working lining.

7. The improvement in apparatus for introducing gas into molten metal set forth in 1 and wherein tubes define said transverse passageways.

8. The improvement in apparatus for introducing gas into molten metal set forth in claim 1 and wherein tubes define said transverse passageways and extend from a surface forming a continuation of the inner surface of said protective refractory brick working lining and communicate with said source of stirring gas and wherein a molten metal chilling device is in communication with said tubes intermediate and stirring block and said source of stirring gas, said metal chilling device acting to freeze and stop molten metal entering the same and escaping from said metallurgical vessel.

* * * * *